US007676187B2

(12) United States Patent
Roof et al.

(10) Patent No.: US 7,676,187 B2
(45) Date of Patent: Mar. 9, 2010

(54) ENHANCED FUSER STRIPPING SYSTEM

(75) Inventors: Bryan J Roof, Newark, NY (US); Elias Panides, Whitestone, NY (US); Nicholas Kladias, Flushing, NY (US); Gerald A Domoto, Briarcliff Manor, NY (US); William A Burton, Rochester, NY (US); Steven M Russel, East Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 279 days.

(21) Appl. No.: 11/862,223

(22) Filed: Sep. 27, 2007

(65) Prior Publication Data

US 2009/0087234 A1 Apr. 2, 2009

(51) Int. Cl.
*G03G 15/20* (2006.01)

(52) U.S. Cl. ..... 399/323

(58) Field of Classification Search ..... 399/322, 399/323, 398, 399; 219/216; 271/307, 309, 271/311, 312, 900

See application file for complete search history.

(56) References Cited

U.S. PATENT DOCUMENTS

| | | | | |
|---|---|---|---|---|
| 4,420,152 | A * | 12/1983 | Miyashita | 271/309 |
| 6,243,556 | B1 * | 6/2001 | Shin | 399/323 |
| 6,517,346 | B1 | 2/2003 | Chen et al. | |
| 6,678,496 | B1 * | 1/2004 | Aslam et al. | 399/323 |
| 6,785,503 | B2 | 8/2004 | Kuo et al. | |
| 6,795,677 | B2 | 9/2004 | Berkes et al. | |
| 7,006,782 | B2 | 2/2006 | Chen et al. | |
| 7,062,211 | B2 * | 6/2006 | Baba et al. | 399/323 |
| 2007/0206981 | A1 * | 9/2007 | Amico et al. | 399/323 |

FOREIGN PATENT DOCUMENTS

| | | | |
|---|---|---|---|
| JP | 2005157179 | A * | 6/2005 |
| JP | 2007086132 | A * | 4/2007 |

* cited by examiner

*Primary Examiner*—Robert Beatty

(57) ABSTRACT

An improved fuser includes a fuser member, a pressure member that forms a nip with the fuser member through which copy sheets pass to have images fused thereon and an air knife to assist in peeling copy sheets from the fuser member. The air knife has a device connected to it that blocks entrained airflow between the fuser and air knife to reduce fuser cooling and power loss.

20 Claims, 4 Drawing Sheets

ENHANCED FUSER STRIPPING SYSTEM

This invention relates generally to electrostatographic reproduction machines, and more particularly, to a fuser with an improved air knife stripping system.

In electrostatographic printing, commonly known as xerographic or printing or copying, an important process step is known as "fusing". In the fusing step of the xerographic process, dry marking making material, such as toner, which has been placed in imagewise fashion on an imaging substrate, such as a sheet of paper, is subjected to heat and/or pressure in order to melt the otherwise fuse the toner permanently on the substrate. In this way, durable, non-smudging images are rendered on the substrates.

The most common design of a fusing apparatus as used in commercial printers includes two rolls, typically called a fuser roll and a pressured roll, forming a nip therebetween for the passage of the substrate therethrough. Typically, the fuser roll further includes, disposed on the interior there of, one or more heating elements, which radiate heat in response to a current being passed therethrough. The heat from the heating elements passes through the surface of the fuser roll, which in turn contacts the side of the substrate having the image to be fused, so that a combination of heat and pressure successfully fuses the image.

During the fusing process and despite the use of low surface energy materials as the fuser roll surface, there is a tendency for the print substrate to remain tacked to the fuser roll after passing through the nip between the fuser roll and the pressure roll. When this happens, the tacked print substrate does not follow the normal substrate path but rather continues in an actuate path around the fuser roll, eventually resulting in a paper jam which will require operator involvement to remove the jammed paper before any subsequent imaging cycle can proceed. As a result it has been common practice to ensure that the print substrate is stripped from the fuser roll downstream of the fuser nip. One approach is the use of a plurality of stripper fingers placed in contact with the fuser roll to strip the print substrate from the fuser roll. An example of this approach is shown in U.S. Pat. Nos. 6,785,503 B2 and 6,795,677 B2. In U.S. Pat. No. 6,785,503 B2 a stripper finger 70 is used to strip sheets from the surface of a fuser and in U.S. Pat. No. 6,795,677 B2 a stripper finger 70 strips sheets from the fuser roll. While satisfactory in many respects, these devices suffer from difficulties with respect to both fuser roll life and print quality. To ensure an acceptable level of stripping, it is frequently necessary to load such a stripper finger against the fuser roll with such a force and at such a force and at such an attack angle that there is a tendency to peel the silicone rubber off the fuser roll, thereby damaging the roll to such an extent that it can no longer function as a fuser roll. Further, there is a tendency for the stripper fingers to leave finger marks on the sheets and cause wear which results in costly replacements of fuser rolls.

An alternative to the use of stripper fingers to peel sheets from a fuser roll is non-contact air knives. This method places an extrusion with small orifices directed toward the roll in close proximity to the fuser nip. The inside of the air knife has a plenum leading to the plurality of orifices. When this plenum is pressurized at a pressure higher than ambient, the air is forced through the orifices and jets of air impinge on the fuser roll surface. As the paper to be stripped approaches this impinging jet, lift and drag forces cause the paper to peel from the surface of the fuser roll. Since this compressed air flows through this orifice and expands upon exit, the air stream sees something that approaches a reversible adiabatic process, also known as isentropic. This, in turn, means that the temperature of the air stream that impinges on the fuser roll is lower than the temperature of the air that was in the plenum. The resulting effect from the lower jet temperature on the fuser roll is that a forced convection method is provided that removes heat from the fuser roll and ejects it into the surrounding environment. Furthermore, this jet results in a low pressure area between the air knife and the fuser roll, but behind the jet that causes external air from below the air knife to rush into the low pressure area or as commonly called entrained air flow. Not only is there heat convection from the jets, but there is also heat convection due to this entrained flow. If the air in the air knife plenum is room temperature, then the jet is cold and the entrained air actually diminishes some of the cooling effect from the jet. However, if the jet is hot, the entrained air just serves to pull in cooler surrounding air and ultimately wastes more heat.

As an example, in U.S. Pat. No. 6,517,346 B1, a pair of air knives 61 and 62 are provided to aid in release of a fused receiver member after passage of the receiver member through fuser nip 25, with pressured air from air knife 61 generally directed towards the surface of fuser roll 10 and pressured air from air knife 62 generally directed towards the surface of pressure roll 20. An air knife 60 in FIG. 3 of U.S. Pat. No. 7,006,782 B2 is shown positioned to discharge air in a direction shown by arrow 64 to assist in the disengagement of receiver sheets from fuser roll 54. Air stripping systems have the detrimental effect of cooling the fuser roll, which both wastes energy and can lead to gloss nonuniformity. The effect is exacerbated by entrained external air from below the air knife.

Accordingly, an improved fuser system is disclosed that includes an air knife to assist in peeling sheets from a fuser roll and the addition of a device or feature that closes the gap between the air knife and the a fuser roll when the air knife plenum is heated to reduce entrained airflow and thereby reduce fuser cooling and thereby reduce power losses.

The disclosed printer and fuser system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
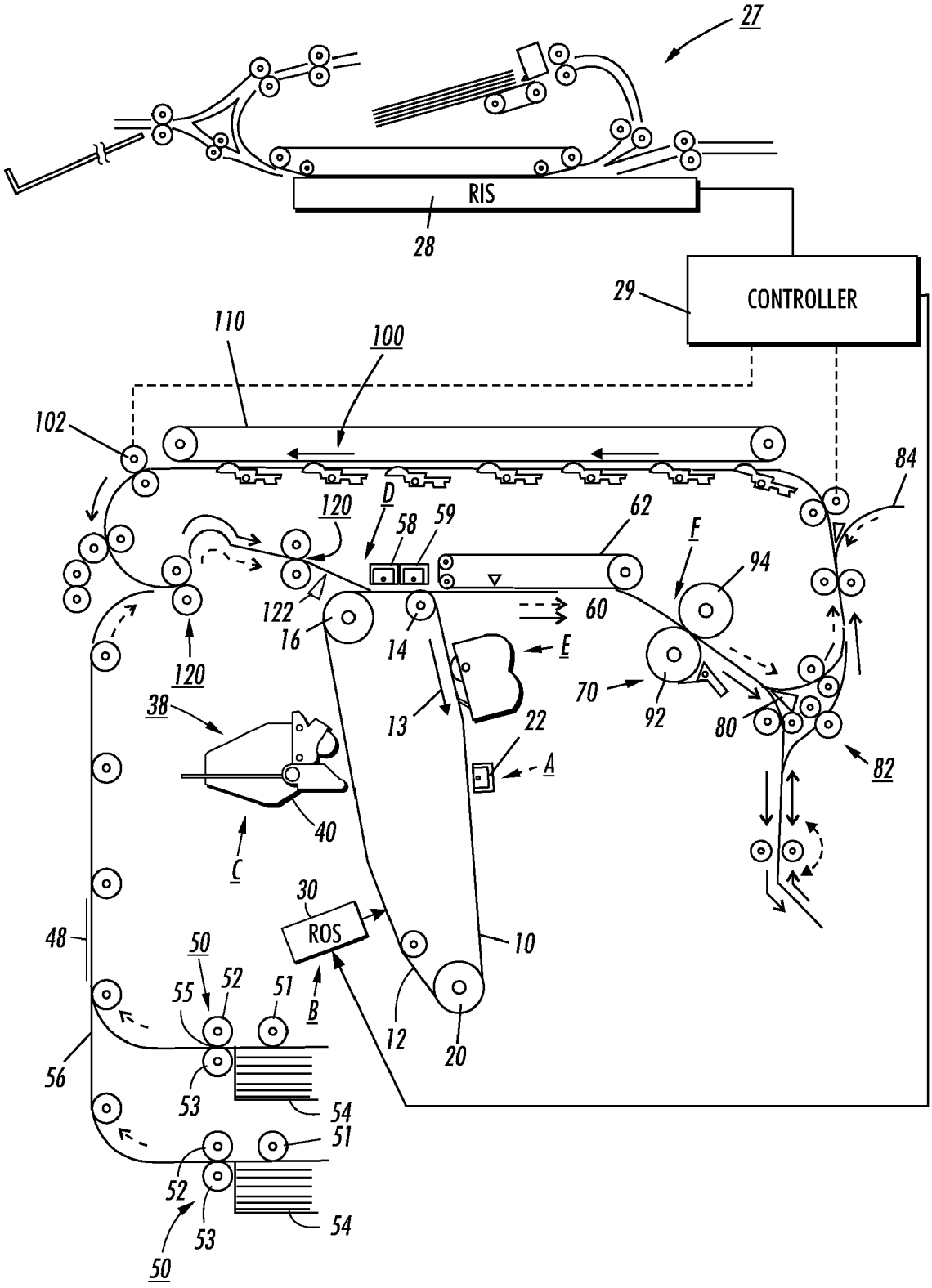
FIG. 1 is an elevational view showing relevant elements of an exemplary toner imaging electrostatographic machine including the fusing apparatus of the present disclosure.

Referring now to FIG. 1 of the drawings, an original document is positioned in a document handler 27 on a raster input scanner (RIS) indicated generally by reference numeral 28. The RIS contains document illumination lamps, optics, a mechanical scanning drive and a charge couple device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a magnetic development unit 38 that includes a housing 40 at station C, where toner is electrostatically attracted to the latent image using commonly known techniques. The latent image attracts toner particles from the carrier granules forming a toner powder image thereon.

With continued reference to FIG. 1, after the electrostatic latent image is developed, the toner powder image present on belt 10 advances to transfer station D. A print sheet 48 is advanced to the transfer station D, by a sheet feeding apparatus, 50. Preferably, sheet feeding apparatus 50 includes a nudger roll 51 which feeds the uppermost sheet of stack 54 to nip 55 formed by feed roll 52 and a retard roll 53. Feed roll 52 rotates to advance the sheet from stack 54 into vertical transport 56. Vertical transport 56 directs the advancing sheet 48 of support material into the registration transport 120 which, in turn, advances the sheet 48 past sheet position sensor 122 and image transfer station D to receive an image from photoconductive belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 90 includes a heated fuser roller 92 and a pressure roller 94 with the powder image on the copy sheet contacting fuser roller 92. The pressure roller is cammed against the fuser roller to provide the necessary pressure to fix the toner powder image to the copy sheet. The fuser roll is internally heated by a quartz lamp (not shown). An air knife 96 is positioned to assist in stripping sheets off the surface of fuser roll 92. Release agent, stored in a reservoir (not shown), is pumped to a metering roll (not shown). A trim blade (not shown) trims off the excess release agent. The release agent transfers to a donor roll (not shown) and then to the fuser roll 92. While fuser and pressure rolls are described herein, it should be understood that a fuser and pressure belts could be used in different combinations in this environment, if desired, such as, belt on roll or belt on belt.

The sheet then passes through fuser 90 where the image is permanently fixed or fused to the sheet. After passing through fuser 90, a gate 80 either allows the sheet to move directly via output 84 to a finisher of stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transport 110, for recirculation back through transport station D and fuser 90 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Figure 2:
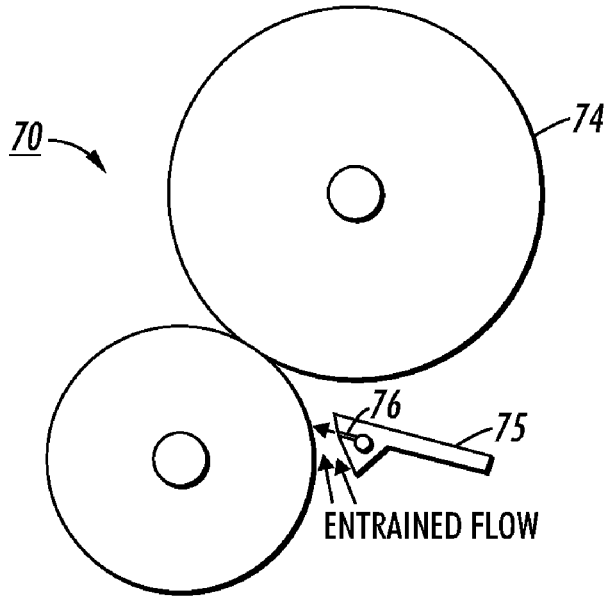
FIG. 2 (PRIOR ART)
FIG. 2 is an enlarged partial schematic, side view of a prior art fusing apparatus that allows entrained airflow.

Referring now to FIG. 2, conventional fusing apparatus 70 includes a rotatable pressure member 74 that is mounted forming a fusing nip with fuser roll 72. A release aid mechanism in the form of an air knife 75 with a nozzle 76 that includes a series of jets is provided to aid release of a fused copy sheet after passage of the copy sheet through the fusing nip, with pressured air from air knife 70 generally directed towards the surface of fuser roll 72. Air knife 75 presents a problem in that it allows entrainment of air flow which results in loss of energy and cooling of the fuser roll.

Figure 3:
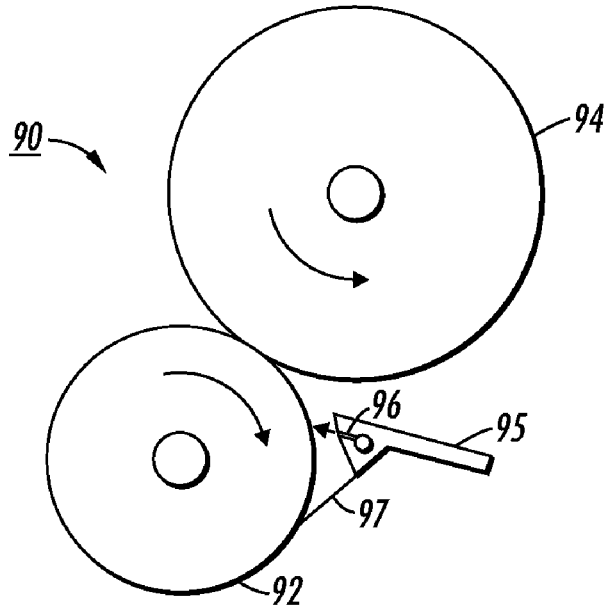
FIG. 3 is an enlarged partial schematic, side view of the fusing apparatus of FIG. 1 that seals the fusing area from entrained airflow.

FIG. 3 shows an improved fusing apparatus 90 that is suitable for uniform and quality heating of unfused toner images in the electrostatographic reproducing machine of FIG. 1. As illustrated, fusing apparatus 90 includes a pressure roll 94 that forms a nip with fuser roll 92. Pressure roll 94 rotates in a counter-clockwise direction while fuser roll 92 rotates in a clockwise direction. An air knife 95 is positioned at an angle of approximately 50° with respect to a nip exit about the center of fuser roll 92 and includes a nozzle 96 having a series of jets to discharge air at an angle of approximately 39° between the jet axis and a tangent to the surface of fuser roll 92 and the impingement point to assist in the disengagement of copy sheets from the fusing surface. In accordance with the present disclosure, a sealing baffle or flap 97 is place close to, but not against, fuser roll 92 to block flow of air from below the air knife. The blocking device 97 could be a thermoset plastic, such as, polyimide brought very close to, but not touching, the surface of the fuser roll. The usual air knife clearance is approximately 3 mm while the baffle clearance should be smaller, e.g., 50 microns to be most effective. The primary purpose for blocking this flow is so that excess energy is not ejected into the input output terminal of the printing machine. The excess heat becomes a noise, ozone, heat and dirt concern while at the same time increasing customer energy costs by wasting energy.

Figure 4:
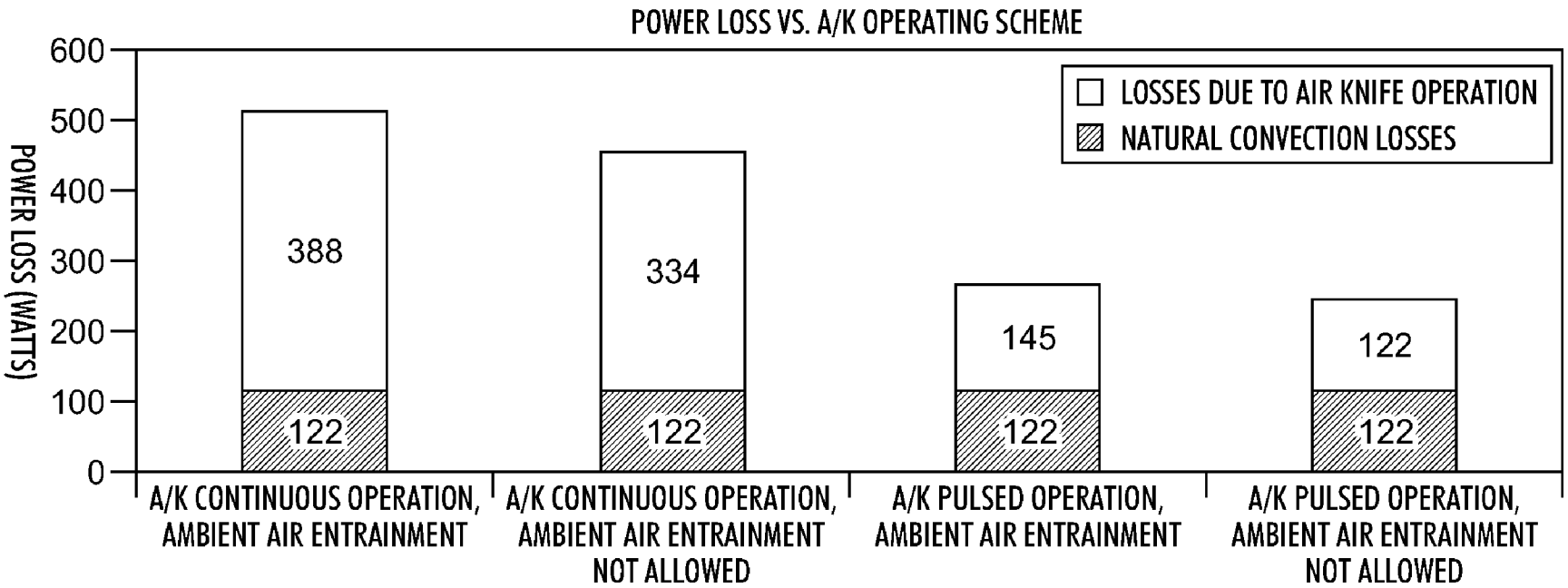
FIG. 4 is a graph showing the thermal effect of using an air knife as a copy sheet stripper mechanism.

The chart in FIG. 4 produced from calculations shows, when using a heated air source, that the convective losses from using a continuous jet stream would be 388 watts without entrainment blocking and a mere 334 watts with entrainment blocking. With pulsed air knife operation, convection losses with ambient air allowed is 145 watts. Once ambient air entrainment is accomplished the convection loss is reduced to 122 watts. It should be understood that while use of a plenum with heated air is preferred, it is entirely satisfactory to use unheated air in the plenum. It should be understood that these numbers are for this particular embodiment and the numbers will surely change for other configurations.

Figure 5:
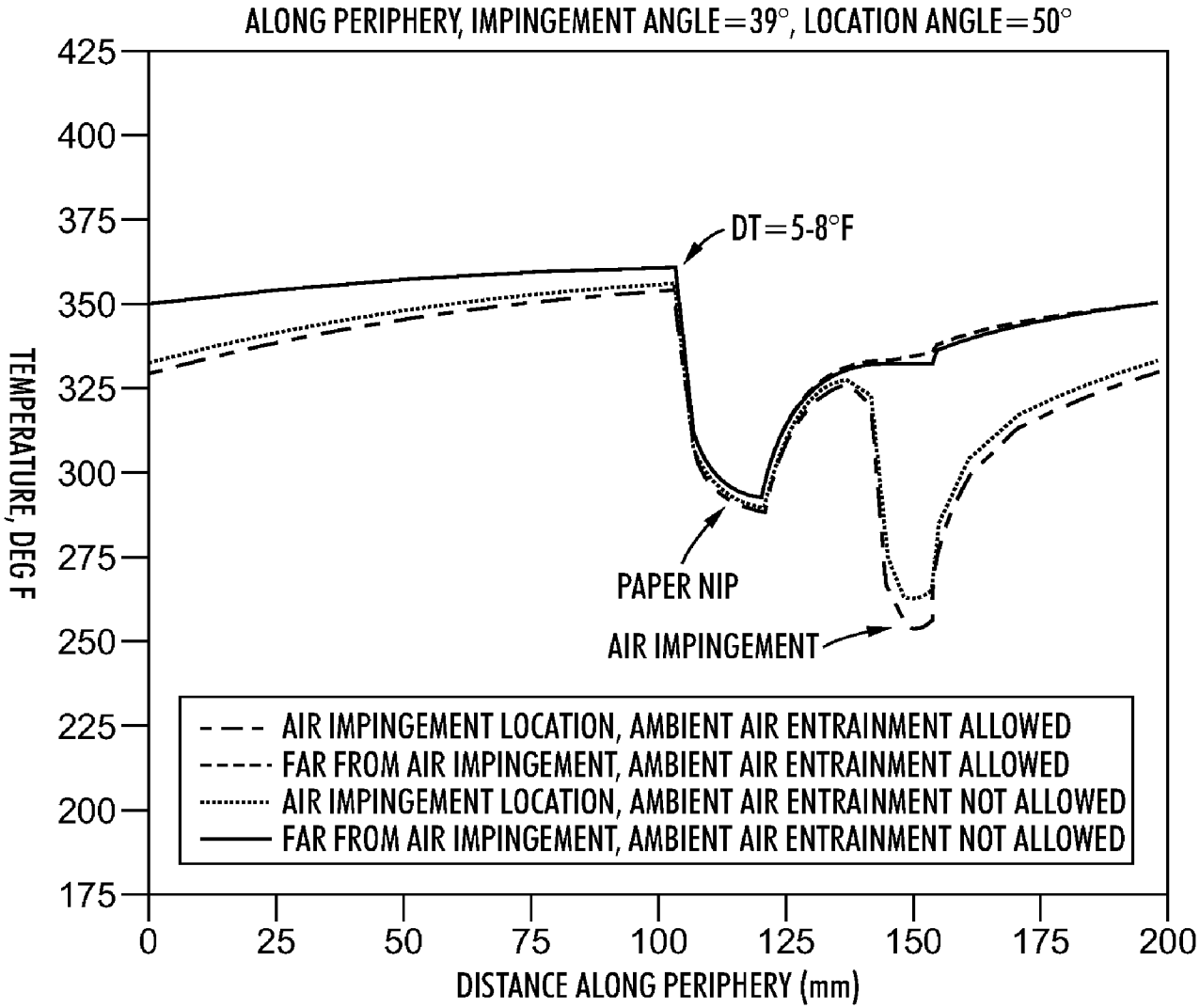
FIG. 5 is a graph showing the effect of ambient air entrainment prevention.

The chart in FIG. 5 shows the effect of ambient air entrainment prevention. As shown, even if the air of the jets is set such that at the impingement point the jet temperature is that of the fuser roll, the entrained air will still cause temperature shift between the jet location and half-way between the jet location and the next jet. When the entrained air path is blocked, the axial delta temperature (DT) differential is significantly reduced from 8° F. to 5° F. which is critical for color machines as it mitigates differential gloss.

It should now be understood that an improved fuser roll system is disclosed that uses an air knife to assist in peeling copy sheets from the surface of a fuser roll while maintaining temperature uniformity of the fuser roll by adding a device to close the gap between the air knife and fuser roll to block entrained airflow and thereby reduce fuser cooling and power loss.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A xerographic device adapted to print images onto copy sheets, comprising:

a fuser for fusing the images onto the copy sheets, the fuser including a fuser member and a pressure member that form a nip therebetween through which the copy sheets are conveyed in order to permanently fuse the images onto each of the copy sheets;

an air knife spaced from the fuser and including a series of jets positioned to apply pressured air to an outer surface of the fuser member to assist in peeling the copy sheets from the outer surface of the fuser member; and an air baffle system for maintaining temperature consistency of the fuser member by obstructing airflow extending over a major portion of the space between the air knife and the fuser member in order to block most all flow of air from behind the jets of the air knife and in between the fuser member and air knife and thereby diminish energy waste and image gloss nonuniformity effects due to entrained air cooling the fuser member.

2. The xerographic device of claim 1, wherein said air baffle system includes an air blocking member.

3. The xerographic device of claim 2, wherein an end portion of said air blocking member is removed from said outer surface of said fuser member by about 100 microns.

4. The xerographic device of claim 3, wherein said air knife is located at angle of about 50° with respect to the nip exit about the center of said fuser member.

5. The xerographic device of claim 4, wherein air from said air knife strikes said outer surface of said fuser member at an angle of about 39° between an axis through said series of jets and a tangent to the surface of said fuser member at an impingement point.

6. The xerographic device of claim 5, wherein said pressured air is unheated.

7. The xerographic device of claim 1, wherein said pressured air is heated.

8. An electrophotographic printing machine including a fuser, said fuser comprising:

a pressure member;

a fuser member that forms a nip with said pressure member through which imaged copy sheets are conveyed in order to permanently fuse the images onto each of the copy sheets;

an air knife including a series of jets is positioned to apply pressured air to an outer surface of said fuser member to assist in peeling said copy sheets from said outer surface of said fuser member, and a blocking member with an end portion thereof positioned a predetermined distance away from and sufficiently close to the fuser member to substantially close a gap between said fuser member and said blocking member in order to enhance the blocking of entrained airflow from below said fuser member and air knife to thereby reduce fuser member cooling and power loss.

9. The electrophotographic printing machine of claim 8, wherein said device blocking member is a flap.

10. The electrophotographic printing machine of claim 9, wherein an end of said flap is removed from said outer surface of said fuser member by about 100 microns.

11. The electrophotographic printing machine of claim 10, wherein said air knife is located at angle of about 50° with respect to the nip exit about the center of said fuser member.

12. The electrophotographic printing machine of claim 11, wherein air from said air knife strikes said outer surface of said fuser member at an angle of about 39° between an axis through said series of jets and a tangent to the surface of said fuser member at an impingement point.

13. The electrophotographic printing machine of claim 12, wherein said pressured air is heated.

14. A method for use in a printer that prints images onto copy sheets and fusing the images to the copy sheets, comprising:

providing a fuser for fusing the images onto each of the copy sheets, the fuser including a fuser member and a pressure member that form a nip therebetween through which the copy sheets are conveyed in order to permanently fuse the images onto the copy sheets;

providing an air knife spaced from the fuser and including a series of jets positioned to apply pressured air to an outer surface of the fuser member to assist in peeling the copy sheets from the outer surface of the fuser member; and providing an air baffle system for maintaining temperature consistency of the fuser member by controlling the gap between the fuser member and area behind the series of jets of the air knife by blocking most all flow of air from behind the series of jets and in between the fuser member and air knife and thereby diminishing energy waste and image gloss nonuniformity effects due to entrained air cooling the fuser member.

15. The method of claim 14, including blocking entrained airflow with a baffle.

16. The method of claim 15, providing said baffle with an end portion removed from said outer surface of said fuser member by about 100 microns.

17. The method of claim 16, wherein said air knife is located at angle of about 50° with respect to the nip exit about the center of said fuser member.

18. The method of claim 17, wherein air from said air knife strikes said outer surface of said fuser member at an angle of about 39° between an axis through said series of jets and a tangent to the surface of said fuser member at an impingement point.

19. The method of claim 18, wherein said pressured air is heated.

20. The method of claim 17, wherein said pressured air is heated.

* * * * *